US006849835B2

(12) United States Patent
Bollmers et al.

(10) Patent No.: US 6,849,835 B2
(45) Date of Patent: Feb. 1, 2005

(54) HOUSEHOLD FOOD WARMER FOR KEEPING FOODS AND BEVERAGES WARM

(75) Inventors: Wolfgang Bollmers, Oelde (DE); Michael Empting, Oelde (DE); Johannes Renne, Ennigerloh (DE); Peter Stemig, Lippstadt (DE); Hartmut Wemhoener, Kirchlengern (DE)

(73) Assignee: Miele & Cie. KG, Guetersloh (DE)

( * ) Notice: Subject to any disclaimer, the term of this patent is extended or adjusted under 35 U.S.C. 154(b) by 0 days.

(21) Appl. No.: 10/740,020

(22) Filed: Dec. 18, 2003

(65) Prior Publication Data

US 2004/0149731 A1 Aug. 5, 2004

(30) Foreign Application Priority Data

Dec. 19, 2002 (DE) ..... 102 60 019

(51) Int. Cl.[7] ..... H05B 3/06

(52) U.S. Cl. ..... 219/520; 219/400; 219/413

(58) Field of Search ..... 219/520, 400, 219/413, 414, 490–494, 710, 757, 507–510, 519, 437, 500, 497

(56) References Cited

U.S. PATENT DOCUMENTS

| | | | | | |
|---|---|---|---|---|---|
| 4,337,384 | A | * | 6/1982 | Tanaka et al. | 219/681 |
| 4,491,065 | A | * | 1/1985 | Poulson | 99/327 |
| 5,097,112 | A | * | 3/1992 | Kanaya et al. | 219/411 |
| 5,111,028 | A | * | 5/1992 | Lee | 219/506 |
| 5,339,726 | A | * | 8/1994 | Poulson | 99/327 |
| 5,432,321 | A | * | 7/1995 | Gerl | 219/506 |
| 5,742,032 | A | * | 4/1998 | Eke | 219/681 |
| 6,140,619 | A | * | 10/2000 | Couch | 219/492 |
| 6,191,391 | B1 | | 2/2001 | Deo et al. | |
| 6,376,805 | B2 | * | 4/2002 | Faries et al. | 219/400 |
| 6,660,974 | B2 | * | 12/2003 | Faries et al. | 219/400 |

FOREIGN PATENT DOCUMENTS

| | | |
|---|---|---|
| DE | 3910585 | 10/1990 |
| DE | 4237570 | 5/1994 |
| DE | 10063911 | 7/2002 |

OTHER PUBLICATIONS

Dacor Warming Oven Use & Care Manual, Dacor Customer Service, 950 South Raymond Avenue, Pasadena, CA 91105, S. Michael Joseph and Anthony B. Joseph.

Dacor Use & Care Manual for Epicure Warming Ovens 24, 27, and 30 inch, Model Nos. EDW/O24, EDWO27, and EDWO30, Part No. 85397 9812, Dacor Customer Service, 950 South Raymond Avenue, Pasadena, CA 91105.

Thermador, Warming Drawer Installation Instructions, Model WD24/WD27/WD30, 1998, Thermador Corporation, 5551 McFadden Avenue, Huntington Beach, CA 92649.

Thermador Warming Drawer Care & Use Manual, Model WD24, WD27 and WD30, 1998, Thermador Corporation, 5551 McFadden Avenue, Huntington Beach, CA 92649.

Miele, Geräte beschreibung (Appliance Description), Built–in Dishwarmer, Model Nr. 05 375 530.

* cited by examiner

*Primary Examiner*—Robin O. Evans
*Assistant Examiner*—Vinod Patel
(74) *Attorney, Agent, or Firm*—Davidson, Davidson & Kappel, LLC

(57) ABSTRACT

A household food warmer for keeping foods and beverages warm includes a housing, a drawer which can be inserted into the housing, an interior chamber which is bounded by the housing and the inserted drawer and which is used to accommodate foods placed on plates, a heating element, an electrical circuit in which is arranged a first electrical switch for switching on the heating element, and a temperature sensor for measuring the interior chamber temperature. A convection fan is provided. The convection fan can be switched on via a second electrical switch arranged in the electrical circuit and can be switched off via the second electrical switch upon the occurrence of a switching condition that is dependent on the temperature sensor.

17 Claims, 5 Drawing Sheets

HOUSEHOLD FOOD WARMER FOR KEEPING FOODS AND BEVERAGES WARM

Priority is claimed to German patent application DE 102 60 019.8, which is hereby incorporated by reference herein.

The present invention relates in general to household food warmers, and particularly to a household food warmer having a convection fan.

BACKGROUND

Household food warmers for keeping foods and beverages warm are generally known and offered by different manufacturers. For example, the Dacor Company of Pasadena, USA, distributes such a household food warmer under the name "EDWO30S". The known household food warmer includes a housing, a drawer which can be inserted into the housing, and has an interior chamber which is bounded by the housing and the inserted drawer, and which is used to accommodate the foods placed on plates. The plates are placed on the top side of a drawer bottom. To heat the interior chamber, the known household food warmer is further equipped with a heating element, which is located at the inner housing wall facing the top side of the drawer bottom, an electrical circuit in which are arranged a first electrical switch for switching on the heating element, and a temperature sensor for measuring the interior chamber temperature.

A household food warmer of this kind is known, for example, from U.S. Pat. No. 6,191,391 B1. The known household food warmer has an electrical circuit in which a temperature sensor and a switch are arranged in series with the heating element; the temperature sensor and the switch being connected in parallel with each other. Depending on the position of the first electrical switch, the heating power of the heating element can be set by the on-time thereof. As soon as the temperature in the interior chamber of the household food warmer is lower than a predetermined setpoint temperature, the temperature sensor, which is designed as a temperature-controlled switch, is closed, and the heating element is switched on, independently of the position of the first electrical switch. Once the setpoint temperature is reached, the temperature-controlled switch opens, and the heating power is dependent on the position of the first electrical switch.

An oven having a convection fan is known from German Patent Application DE 42 37 570 A1, which is hereby incorporated by reference herein. However, when a switching condition that is dependent on the temperature sensor is reached, the convection fan is not switched off via a second electrical switch by means of a relay, but by the temperatures sensor itself, the temperature sensor being designed as a temperature-controlled switch. Moreover, the above document only reveals that the second electrical switch can be operated manually, and that the heating element and the convection fan can be switched on together by the second electrical switch. Thus, it is up to the user when to switch on the convection fan for purpose of quick heating. In the context of the subject matter of the above document, the heating element and the fan are jointly connected into the circuit in addition to the already energized top heating and bottom heating elements in order to provide full heating power during a heat-up phase. For a subsequent continued heating phase, the heating power is reduced by switching off the heating element along with the convection fan.

SUMMARY OF THE INVENTION

Thus, it is an object of the present invention to provide a household food warmer and a method for keeping foods and beverages warm in a household food warmer, in which quick heating to a desired interior chamber temperature is achieved with reduced thermal loading of the surface of the foods and beverages placed in the interior chamber.

The present invention provides a household food warmer for keeping foods and beverages warm. The household food warmer includes a housing, a drawer which can be inserted into the housing, an interior chamber which is bounded by the housing and the inserted drawer, and which is used to accommodate foods placed on plates, a heating element, an electrical circuit in which are arranged a first electrical switch for switching on the heating element, and a temperature sensor for measuring the interior chamber temperature. The household food warmer has a convection fan, which can be switched on via a second electrical switch arranged in the electrical circuit, and which can be switched off via the second electrical switch by means of a relay upon the occurrence of a switching condition that is dependent on the temperature sensor. The household food warmer has a main electrical switch by which the convection fan and the heating element can be switched on together when setting the household food warmer into operation is arranged in the electrical circuit; the main electrical switch being connected to a time selector mechanically, electromechanically, or electrically, and held in a closed position depending on a keep-warm time which can be set at the time selector. The convection fan, after being switched on, can only be switched on again after the main electrical switch has been moved from a closed position into an open position, i.e., by disconnecting the relay from the electrical network.

In addition to quick heating to a desired interior chamber temperature with reduced thermal loading of the surface of the foods and beverages placed in the interior chamber, an advantage that can be achieved with the present invention is a more uniform initial heating because the air heated by the heating element is distributed in the interior chamber by the convection fan. Thus, for example, in spite of quick heating to the desired interior chamber temperatures, the food is substantially prevented from drying out, thus maintaining the taste and appearance of the food that is placed in the interior chamber to be kept warm. This is true in particular for higher keep-warm temperatures, which, in the known household food warmer, require either a higher initial heating power of the heating element, or a longer initial heat-up time. Since the convection fan is only switched on for the relatively short initial heat-up time, the convection fan has a long service life.

In an advantageous refinement of the teaching according to the present invention, provision is made for the household food warmer to have a temperature selector for selecting the predetermined setpoint temperature. In this manner, the interior chamber temperature can be adapted to the food or beverage placed in the interior chamber, and to the needs of the user.

The heating element can, in principle, be selected according to type, size, material, and heating power within wide suitable limits. Conveniently, the heating element is designed as an electric radiant heating element because electric radiant heating elements are cost-effective standard components.

In an embodiment of the present invention, the foods and beverages can be placed on the top side of a drawer bottom, and that the heating element and/or the convention fan is/are located in a region of the housing facing the top side of the drawer bottom. This promotes the transfer of heat from the heating element to the foods and beverages, resulting in shorter heat-up time and reduced energy requirement.

In a further embodiment, at least the main part of the electrical circuit and the heating element and/or the convection fan are designed as a combined unit. In this manner, it is possible to arrange these components in a compact manner. It is also possible to purchase the complete combined unit externally, and to mount it at or in the housing of the household food warmer with little installation effort.

In another embodiment of the present invention, provision is made for the electrical circuit to be designed as an integrated electronic circuit. In this manner, it is possible to further reduce the space requirement. The space thus gained can be used for additional components, or for more powerful and therefore larger components, such as a more powerful convection fan.

In yet another embodiment, it is proposed that a bridging device having a manually operable bridging switch is arranged in the electrical circuit, it being possible for the convection fan to be switched on when the bridging switch is in a closed position, independently of the switching condition of the temperature sensor. This allows the household food warmer according to the present invention to be operated also in a plate warming mode, in which the convection fan is switched on for the whole keep-warm time, thus ensuring a particularly good transfer of heat between the heating element and the plates.

BRIEF DESCRIPTION OF THE DRAWINGS

An exemplary embodiment of the present invention is shown in the drawings in purely schematic way and will be described in more detail below. In the drawings.

DETAILED DESCRIPTION

Figure 1:
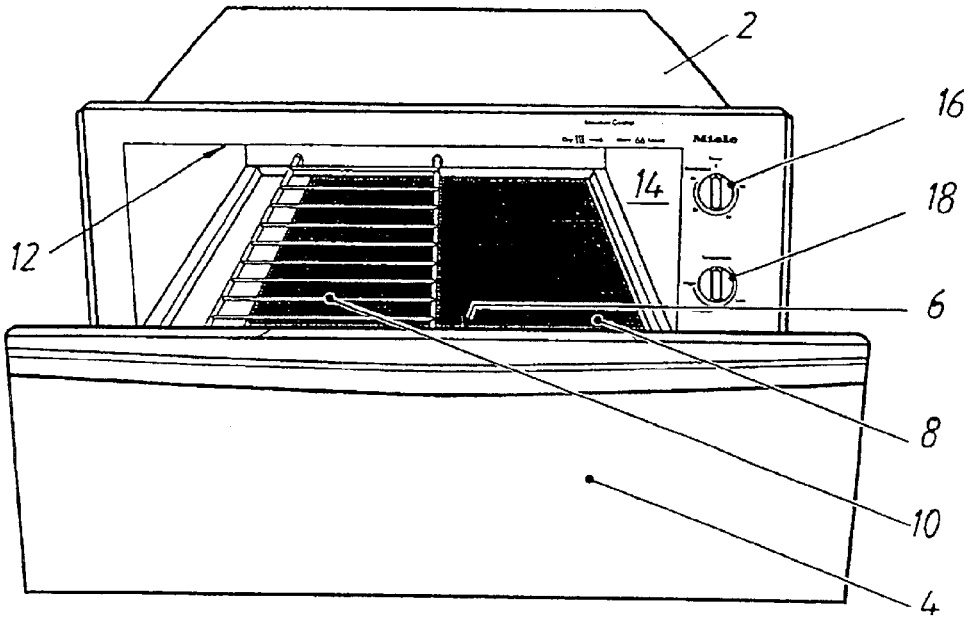
FIG. 1 is a perspective view of a first embodiment of household food wanner according to the present invention.

FIG. 1 shows a first embodiment of a household food warmer according to the present invention for keeping foods and beverages warm. The household food warmer has a housing 2, and a drawer 4 which can be inserted into and held on housing 2. In FIG. 1, drawer 4 is only partially inserted into housing 2. In the closed position of drawer 4, that is, when drawer 4 is fully inserted, an interior chamber 6 is bounded by housing 2 and drawer 4. Interior chamber 6 is designed to accommodate foods placed on plates and beverages filled in drinking vessels. In this embodiment, the plates and drinking vessels can be placed on top side 8 of a drawer bottom. Alternatively or additionally, a rack 10, on which plates and drinking vessels may be placed, can be arranged in interior chamber 6. A heating element, which is designed as an electric radiant heating element, is located at ceiling 12 of interior chamber 6, which is formed on housing 2 and faces top side 8; the heating element being capable of being switched on and off via a first electrical switch arranged in an electrical circuit, which is also not shown in FIG. 1. The electrical circuit and the electrical components arranged therein are explained in more detail in FIG. 2. Moreover, a temperature sensor for measuring the interior chamber temperature is located at ceiling 12. At the side wall 14 of interior chamber 6, which is shown on the right in the image plane, and which is formed on housing 2 and faces top side 8, there is arranged a convection fan, which can be switched on and off via a second electrical switch that is also arranged in the electrical circuit.

Also arranged in the electrical circuit is a main electrical switch by which the convection fan and the heating element can be switched on together when setting the household food warmer into operation. The main electrical switch of the embodiment is mechanically connected to a time selector 16 arranged on housing 2, so that the main electrical switch is held in its closed position for a keep-warm time which can be set using time selector 16. In a departure from this, an electromechanical or electrical connection of the main electrical switch to time selector 16 is also conceivable.

Furthermore, the household food warmer of the present embodiment has a temperature selector 18, which is arranged on housing 2 and used for selecting the predetermined setpoint temperature. Temperature selector 18 will be explained in greater detail with reference to FIG. 2.

In this embodiment, the components that are arranged on side wall 14, namely the convection fan, the main part of the electrical circuit, as well as time selector 16, and temperature selector 18, are designed as a combined unit.

Figure 2:
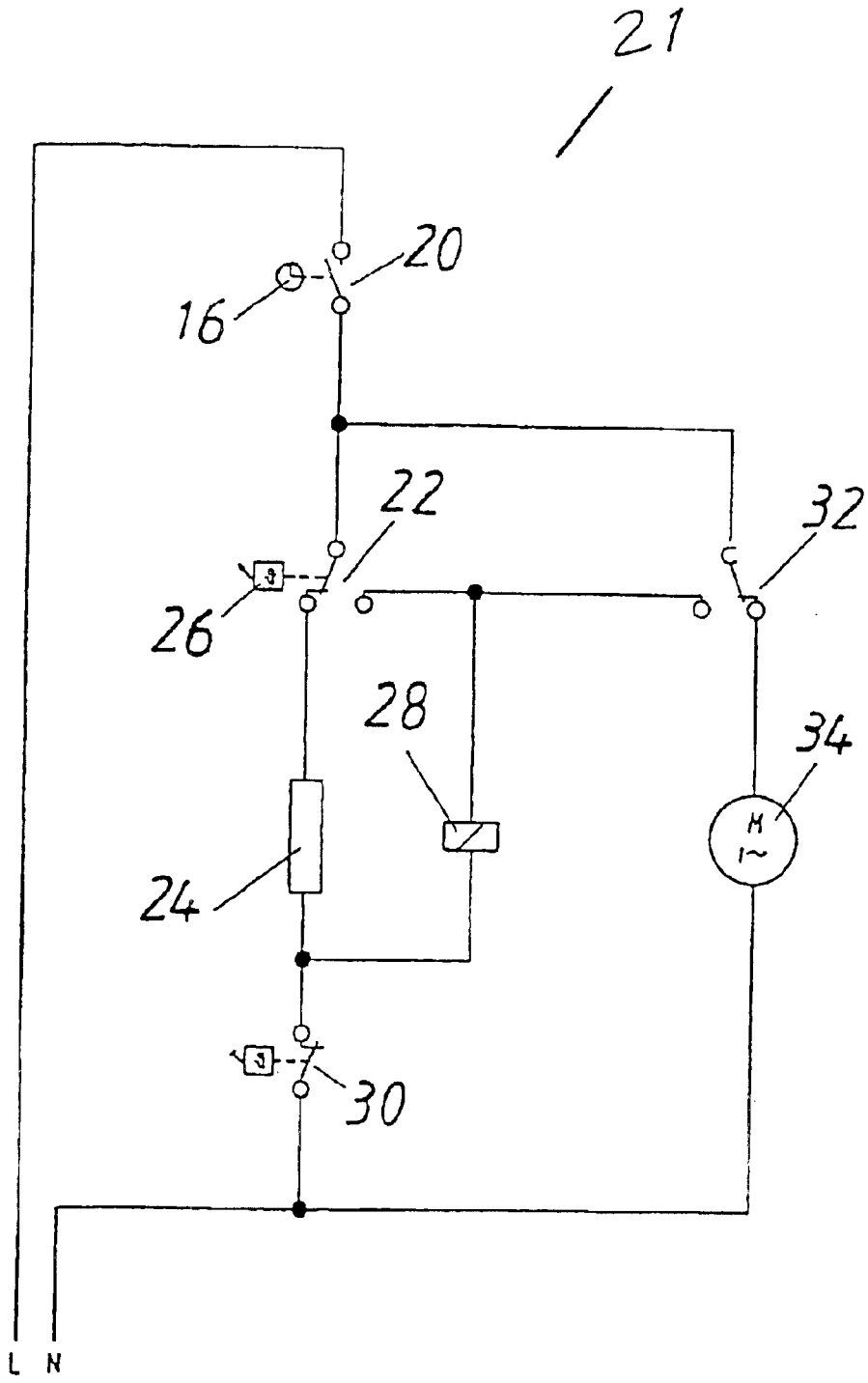
FIG. 2 shows a circuit diagram of an electrical circuit of the household food warmer of FIG.1.

FIG. 2 shows a circuit diagram of the electrical circuit 21 of the present embodiment with main electrical switch 20 in an open position. As explained before, main electrical switch 20 is mechanically connected to time selector 16. First electrical switch 22, via which heating element 24 can be switched on, is designed as a changeover switch and mechanically connected to temperature sensor 26, which is designed as a capillary tube sensor. When first electrical switch 22 is in the normal position shown, heating element 24 can be connected to an electrical network. When first electrical switch 22 is in the displaced position, a relay 28 connected in parallel with heating element 24 can be connected to the electrical network. A temperature switch 30, which is designed as a bimetallic switch and shown in FIG. 2 in its normal position, is connected in series with first electrical switch 22 and relay 28. Second electrical switch 32, which is also designed as a changeover switch, and convection fan 34 are arranged in the electrical circuit in parallel with the arrangement made up of first electric switch 22, heating element 24, and temperature switch 30. When second electrical switch 32 is in the normal position shown, convection fan 34 can be connected to the electrical network.

The mode of operation of the above embodiment of the household food warmer according to the present invention will now be explained in more detail with reference to FIGS. 1 and 2.

The foods to be kept warm are placed on top side 8 of the drawer bottom and on rack 10 when drawer 4 is in a retracted position. The desired keep-warm time, for example, 30 minutes, is set at time selector 16 by displacement from its neutral position, and the desired keep-warm temperature, for example, 60° C., is set as a setpoint temperature for the interior chamber at temperature selector 18 by displacement from its neutral position. After that, drawer 4 is fully inserted into housing 2 of the household food warmer.

When time selector 16 is displaced from its neutral position, main electrical switch 20 is closed. Since first electrical switch 22, second electrical switch 32, and temperature switch 30 are in their normal positions, heating element 24 and convection fan 34 are thereby simultaneously connected to the electrical network, and relay 28 is disconnected from the electrical network. The displacement of time selector 16 from its neutral position initiates the first heat-up time, which extends until the predetermined setpoint temperature (iii this example 60° C.) is measured by temperature sensor 26 in the interior chamber. As soon as this occurs, first electrical switch 22 is automatically moved from its normal position to its displaced position so that heating element 24 is disconnected from the electrical network. As soon as first electrical switch 22 is in its displaced position, relay 28 is electrically conductively connected to the electrical network, and second switch 32 is moved by relay 28 from the normal position to the displaced position. When second electrical switch 32 is moved to its displaced position, convection fan 34 is also disconnected from the electrical network. When the predetermined setpoint temperature is reached for the first time, heating element 24 and convection fan 34 are automatically switched off, and the initial heat-up time has elapsed.

The interior chamber of the household food warmer gradually cools down due to heat losses so that the interior chamber temperature falls to a level below the predetermined setpoint temperature (in this example 60° C.). When temperature sensor 26 measures an internal chamber temperature that is below the setpoint temperature, first electrical switch 22 is caused to automatically move back from its displaced position to its normal position so that heating element 24 is electrically conductively connected to the electrical network again. The interior chamber is reheated to the predetermined setpoint temperature. During this reheating process, convection fan 34 remains switched off since relay 28 remains electrically conductively connected to the electrical network because second electrical switch 32 is in the displaced position. As soon as the predetermined setpoint temperature is reached again, heating element 24 is automatically disconnected as described above, and the sequence illustrated here starts again. This alternation is repeated until the keep-warm time which was previously set using time selector 16 has elapsed, and time selector 16 is thereby automatically moved back to its normal position. As soon as main electrical switch 20 has opened, heating element 24 and relay 28 are disconnected from the electrical network. First and second electrical switches 22, 32 are automatically moved to their normal positions. The household food warmer is switched off.

As explained before, in the present embodiment, provision is made for a temperature switch 30. If a malfunction of the above-described arrangement should occur, as a result of which the interior chamber temperature exceeds a predetermined maximum temperature, for example, 80° C., temperature switch 30 opens automatically so that heating element 24 is disconnected from the electrical network. Temperature switch 30 does not switch off convection fan 34, or, in the case convection fan 34 was switched off, convection fan 34 is automatically switched on again. Thus, it is ensured that the interior chamber temperature is quickly reduced, and that local overheating is avoided.

Figure 3:
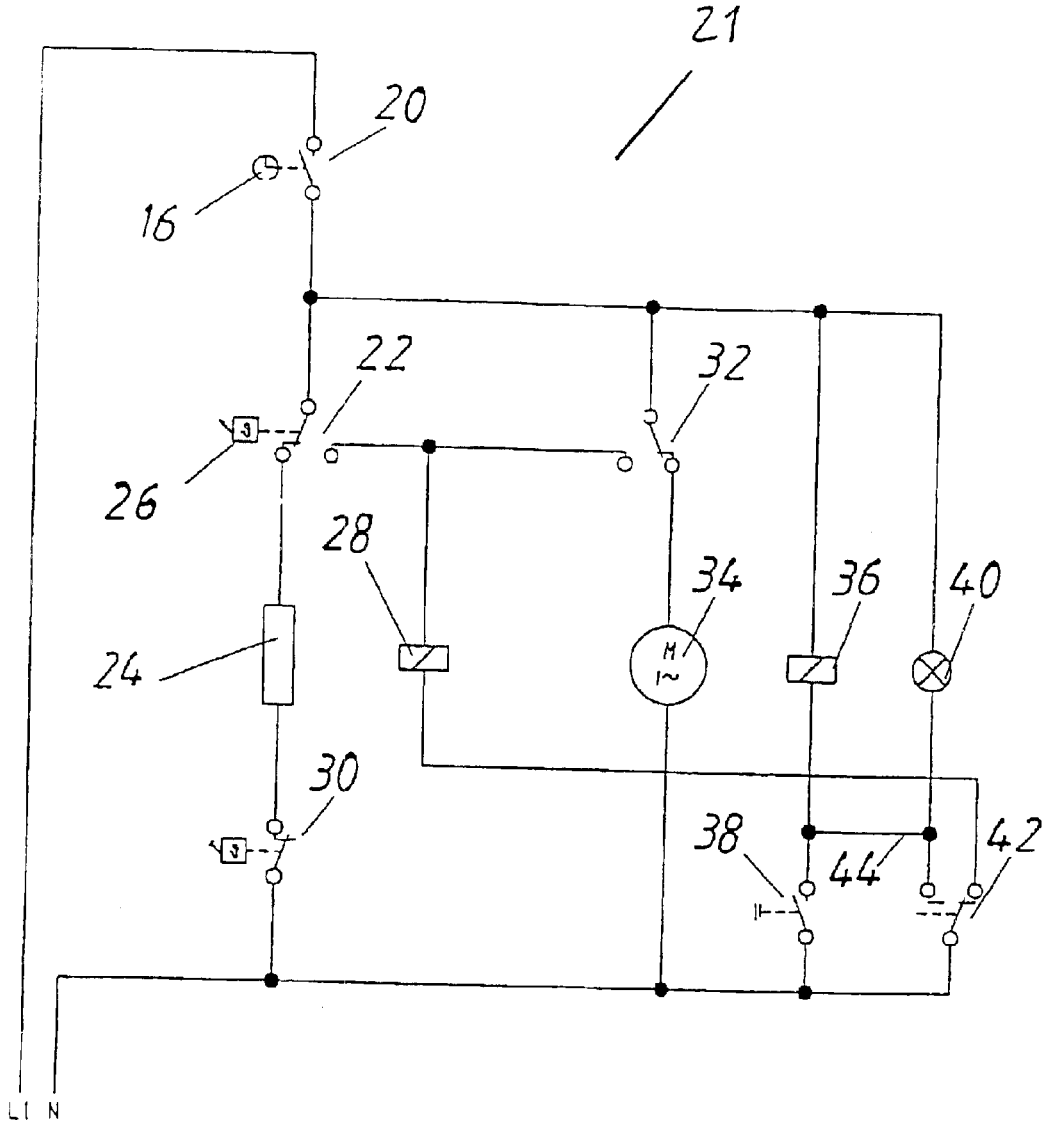
FIG. 3 shows a circuit diagram of an electrical circuit of a second embodiment of a household food warmer according to the present invention.

FIG. 3 shows a circuit diagram of the electrical circuit 21 of a second embodiment of a household food warmer according to the present invention. In a departure from the first embodiment described with reference to FIGS. 1 and 2, a bridging device is arranged in the electrical circuit of the second embodiment. The bridging device has two electrical paths connected in parallel with second switch 32 and convection fan 34. A further relay 36 and a manually operable bridging switch 38 are arranged in the first electrical path. Manually operable bridging switch 38 is shown in FIG. 3 in its normal position, namely in the open position. A control lamp 40 and a further electrical changeover switch 42 are arranged in the second electrical path; the further electrical changeover switch 42, when in its normal position shown in FIG. 3, electrically conductively connecting relay 28 to the neutral conductor of the electrical network. Electrical bridging switch 38 and control lamp 40 are arranged on housing 2 of the household food warmer according to the present invention, analogously to time selector 16 and temperature selector 18. Moreover, the first and second electrical paths are electrically conductively connected via a third electrical path 44 in such a manner that a single closure of electrical bridging switch 38 is sufficient to switch on convection fan 34 for the whole keep-warm time, that is, for as long as main electrical switch 20 is closed.

The mode of operation of the second embodiment will now be explained in more detail with reference to FIG. 3.

The household food warmer according to the present invention has been set into operation as described above. As long as the user does not operate electrical bridging switch 38 after setting the household food warmer according to the present invention into operation, the mode of operation is the same as that already explained with reference to the first embodiment. If electrical bridging switch 38 is now manually closed, further relay 36 is connected to the electrical network, and automatically moves further changeover switch 42 from its normal position to its displaced position so that relay 28 is disconnected from the electrical network independently of the position of first electrical switch 22. Consequently, second electrical switch 32 remains in its normal position, and the convection fan remains electrically conductively connected to the electrical network for the whole keep-warm time. By moving further electrical changeover switch 42 to its displaced position, control lamp 40 is also electrically conductively connected to the electrical network.

Figure 4:
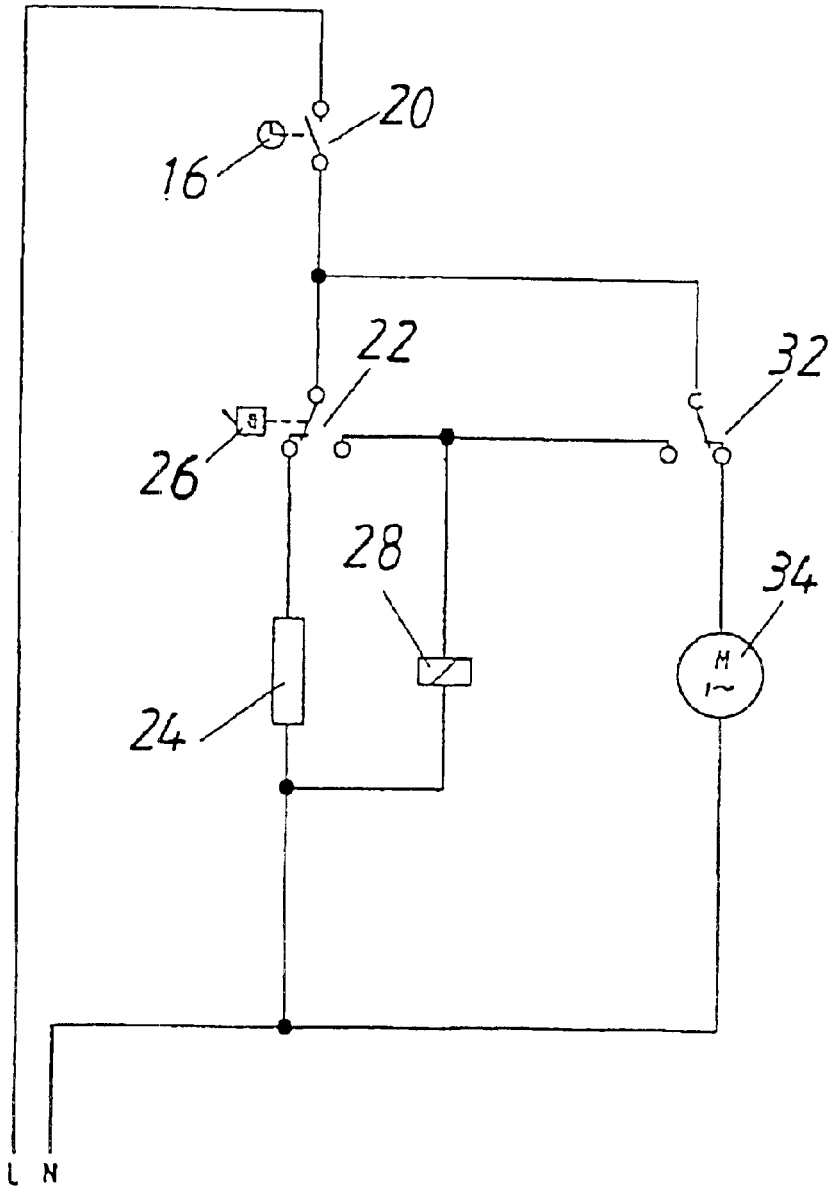
FIG. 4 shows a circuit diagram of an electrical circuit of a third embodiment of a household food warmer according to the Present invention.

FIG. 4 shows a circuit diagram of an electrical circuit of the present invention without the temperature switch 30 described above relative to the embodiment depicted in FIG. 2. In this embodiment, convection fan 34, after being switched on, can only be switched on again after main electrical switch 20 has been moved from a closed position into an open position, i.e., by disconnecting relay 28 from the electrical network.

Figure 5:
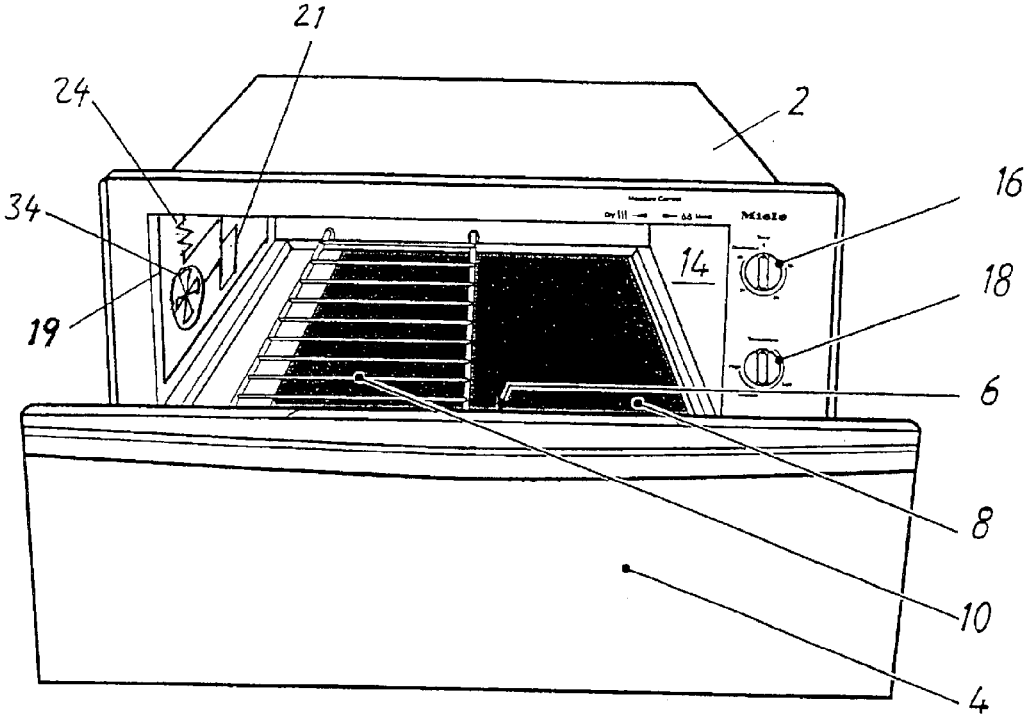
FIG. 5 shows a Perspective view of a fourth embodiment of a household food warmer according to the present invention.

FIG. 5 shows an embodiment with electrical circuit 21, heating element 24 and convection fan 34 as a combined unit 19. Electrical circuit 21 is here designed as an integrated electronic circuit.

What is claimed is:

1. A household food warmer for keeping foods and beverages warm, comprising:

a housing;

a drawer insertable into the housing;

an interior chamber bounded by the housing and the inserted drawer, the interior chamber being configured to receive foods placed on plates;

a heating element;

a convection fan; and an electrical circuit including:

a first electrical switch configured to switch on the heating element;

a temperature sensor configured to measure a temperature of the interior chamber;

a relay;

a second electrical switch configured to switch on the convection fan and to switch off the convection fan using the relay upon the occurrence of a switching condition dependent on the temperature sensor; and a main electrical switch configured to switch on the convection fan and the heating element together when the household food warmer is set into operation, the main electrical switch being connected to a time selector at least one of mechanically, electromechanically and electrically, the main electrical switch being maintainable in a closed position depending on a keep-warm time settable using the time selector;

wherein the convection fan, after being switched on, can be switched on again only after the main electrical switch has been moved from the closed position to an open position.

2. The household food warmer as recited in claim 1 wherein the convection fan, after being switched on, can only be switched on again after the main electrical switch has been moved from the closed position into an open position by a disconnecting the relay from the electrical network.

3. The household food warmer as recited in claim 1 further comprising a temperature selector configured to select a predetermined temperature set point.

4. The household food warmer as recited in claim 1 wherein the heating element is an electric radiant beating element.

5. The household food warmer as recited in claim 1 wherein a top side of a bottom of the drawer is configured to receive the foods and beverages, and wherein at least one of the heating element and the convention fan is located in a region of the housing facing the top side.

6. The household food warmer as recited in claim 1 wherein at least a major portion of at least two of the electrical circuit, the heating element and the convection fan are a combined unit.

7. The household food warmer as recited in claim 1 wherein the electrical circuit includes an integrated electronic circuit.

8. A household food wanner for keeping foods and beverages warm, comprising:

a housing;

a drawer insertable into the housing;

an interior chamber bounded by the housing and the inserted drawer, the interior chamber being configured to receive foods placed on plates;

a heating element;

a convection fan; and an electrical circuit including:

a first electrical switch configured to switch on the heating element;

a temperature sensor configured to measure a temperature of the interior chamber;

a relay;

a second electrical switch configured to switch on the convection fan and to switch off the convection fan using the relay upon the occurrence of a switching condition dependent on the temperature sensor; and a main electrical switch configured to switch on the convection fan and the heating element together when the household food warmer is set into operation, the main electrical switch being connected to a time selector at least one of mechanically, electromechanically and electrically, the main electrical switch being maintainable in a closed position depending on a keep-warm time settable using the time selector; and a bridging device having a manually operable bridging switch;

wherein the convection fan, after being switched on, can be switched on again only after at least one of the following conditions are met:

the main electrical switch has been moved from the closed position to an open position;

a predetermined maximum interior temperature is reached; and the bridging switch is in a closed position.

9. The household food warmer as recited in claim 8 wherein a meeting of at least one of the conditions causes the relay to be disconnected from the electrical network.

10. The household food warmer as recited in claim 8 further comprising a temperature selector configured to select a predetermined temperature set point.

11. The household food warmer as recited in claim 8 wherein the heating element is an electric radiant heating element.

12. The household food warmer as recited in claim 8 wherein a top side of a bottom of the drawer is configured to receive the foods and beverages, and wherein at least one of the heating element and the convention fan is located in a region of the housing facing the top side.

13. The household food warmer as recited in claim 8 wherein at least a major portion of at least two of the electrical circuit, the heating element and the convection fan are a combined unit.

14. The household food warmer as recited in claim 8 wherein the electrical circuit includes an integrated electronic circuit.

15. A household food wanner for keeping foods and beverages warm, comprising:

a housing;

a drawer insertable into the housing;

an interior chamber bounded by the housing and the inserted drawer, the interior chamber being configured to receive foods placed on plates;

a heating element;

a convection fan; and an electrical circuit including:

a first electrical switch configured to switch on the heating element;

a temperature sensor configured to measure a temperature of the interior chamber;

a relay;

a second electrical switch configured to switch on the convection fan and to switch off the convection fan using the relay upon the occurrence of a switching condition dependent on the temperature sensor; and a main electrical switch configured to switch on the convection fan and the heating element together when the household food warmer is set into operation, the main electrical switch being connected to a time selector at least one of mechanically, electromechanically and electrically, the main electrical switch being maintainable in a closed position depending on a keep-warm time settable using the time selector; and a bridging device having a manually operable bridging switch;

wherein the convection fan, after being switched on, can be switched on again only after the main electrical switch has been moved from the closed position to an open position or, independently of a switching condition of the temperature sensor, when the bridging switch is in a closed position.

16. The household food warmer as recited in claim 15 wherein moving the main electrical switch from the closed position to the open position or moving the bridging switch into the closed position causes the relay to be disconnected from the electrical network.

17. The household food warmer as recited in claim 15 further comprising a temperature selector configured to select a predetermined temperature set point.

* * * * *

UNITED STATES PATENT AND TRADEMARK OFFICE

CERTIFICATE OF CORRECTION

PATENT NO. : 6,849,835 B2
DATED : February 1, 2005
INVENTOR(S) : Wolfgang Bollmers et al.

It is certified that error appears in the above-identified patent and that said Letters Patent is hereby corrected as shown below:

Column 3,
Line 33, should read -- warmer -- instead of “wanner”.
Line 42, should read -- present -- instead of “Present”.
Line 43, should read -- perspective -- instead of “Perspective”.

Column 4,
Line 61, should read -- 60º C --, instead of “60º C.”.

Column 5,
Line 7, should read -- in -- instead of “iii”.
Line 52, should read -- 80º C --, instead of “80º C.”.

Column 7,
Line 29, should read -- heating -- instead of “beating”.
Line 34, should read -- convection fan -- instead of “convention fan”.
Line 43, should read -- warmer -- instead of “wanner”.

Column 8,
Lines 35, should read -- warmer -- instead of “wanner”.

Signed and Sealed this

Thirteenth Day of December, 2005

JON W. DUDAS
*Director of the United States Patent and Trademark Office*